US006511034B2

(12) United States Patent
Nicholson et al.

(10) Patent No.: US 6,511,034 B2
(45) Date of Patent: Jan. 28, 2003

(54) TEMPORARY POST SUPPORT

(75) Inventors: Samuel J. Nicholson, League City, TX (US); Daniel H. L. Chang, Houston, TX (US)

(73) Assignee: Think Inc. Enterprises, League City, TX (US)

( * ) Notice: Subject to any disclaimer, the term of this patent is extended or adjusted under 35 U.S.C. 154(b) by 0 days.

(21) Appl. No.: 09/899,340

(22) Filed: Jul. 5, 2001

(65) Prior Publication Data

US 2002/0005467 A1 Jan. 17, 2002

Related U.S. Application Data

(60) Provisional application No. 60/217,812, filed on Jul. 12, 2000.

(51) Int. Cl.[7] ..... F16M 13/00

(52) U.S. Cl. ..... 248/523; 248/533; 248/218.4

(58) Field of Search ..... 248/530, 156, 248/523, 533, 218.4, 219.1; 256/64, 35, 59; 52/156, 158

(56) References Cited

U.S. PATENT DOCUMENTS

| | | | | |
|---|---|---|---|---|
| 327,427 A | | 9/1885 | Zeigler | |
| 783,837 A | * | 2/1905 | Johnston | 248/216.1 |
| 1,107,016 A | * | 8/1914 | Bailey | |
| 2,826,281 A | | 3/1958 | Johnson | |
| 2,896,918 A | | 7/1959 | Ward | |
| 3,044,738 A | | 7/1962 | Kuchera et al. | |
| 3,057,601 A | | 10/1962 | Simpson | |
| 3,332,654 A | * | 7/1967 | Jacobson | 211/107 |
| 3,468,428 A | * | 9/1969 | Reibold | |
| 3,950,874 A | | 4/1976 | Diggs | |
| 4,588,157 A | * | 5/1986 | Mills | |
| 4,706,921 A | | 11/1987 | Paulin | |
| 5,002,252 A | * | 3/1991 | Setala et al. | |
| 5,088,672 A | | 2/1992 | Neuendorf et al. | |
| 5,090,656 A | * | 2/1992 | Brown | |
| 5,104,074 A | | 4/1992 | Malloy | |
| 5,377,944 A | * | 1/1995 | Getsinger | |
| 5,590,865 A | | 1/1997 | Odom | |
| 5,791,635 A | * | 8/1998 | Hull et al. | |

OTHER PUBLICATIONS

"Setting Posts" *Quikrete Project Center Project of the Month*, www.quikrete.com/diycenter/month/posts/post-s.htm.

"How to Install Wood Panel Fencing" *Lowe's Knows—How to Install Wood Panel Fencing*, www.lowes.com/lowes/HOWTO/LIBRARY/outdoor/fence2.asp.

* cited by examiner

*Primary Examiner*—Korie Chan
(74) *Attorney, Agent, or Firm*—Laura M. Peebles

(57) ABSTRACT

The invention is a temporary support for holding a structural member such as a fence post in an upright vertical position during vertical leveling and setting. The support comprises a removable frame that fits around a fence post. The frame has a post-retaining portion and a plurality of leg-receiving portions. The legs are slid in the leg-receiving portions and are capable of sliding in and out of the frame in order to adjustably support the fence post.

18 Claims, 1 Drawing Sheet

TEMPORARY POST SUPPORT

This application claims the benefit of Provisional Application No. 60/217,812, filed Jul. 12, 2000.

BACKGROUND OF THE INVENTION

The present invention relates to an apparatus for temporarily supporting a post in an upright vertical position while it is being erected, made plumb and permanently secured in the ground or other horizontal surface. More particularly, this invention relates to a frame that temporarily attaches to around a fence post. The frame includes a post holding portion and a leg-receiving portion, and a plurality of legs that slide into the frame to securely support the fence post with respect to the ground and allows the fence post to be adjusted prior to it being set.

When building a structure such as a fence, it is often necessary to fix the fence posts in a vertical position while they are being made plumb and permanently secured into the ground. To secure the fence post in the ground, a hole is usually dug in which the fence post is placed. Then the hole is filled with concrete or dirt. The fence post must be fixed vertically and held in this position until the concrete dries or dirt is back-filled. The fence posts could be 2"×4" boards or 4" by 4" board or any other shapes as are known in the art. If the fence posts are not held in the vertical position during the construction, the structure could lean or not be strong enough to support the remainder of the structure. Further, it would not look aesthetically pleasing. Therefore, it is important to have a structural member that is both vertical and secure.

Previously, when one desired to erect a structural member such as a fence post, a hole is drilled into the ground with an auger or other hole-making device. However, the holes provide no lateral support. The structural member needs to be supported upright as the hole is back-filled with dirt or concrete and held in this position until the post is set. This is often accomplished by use of a worker's hands or the post is otherwise braced with old 2" by 4"s or other "junk wood". The junk wood was held in place by other pieces of junk wood, which are driven into the ground and then nailed together. Then the fence post was leveled vertically and set so that it was square. Then the junk wood was removed and discarded.

However, this method had many disadvantages since if the fence posts were not held securely, the fence could lean (not be plumb) or lead to collapse.

Further, the prior system is disadvantageous because it requires additional workers who cannot hold the member securely, it requires additional materials, and the system is not adjustable and reusable.

SUMMARY OF THE INVENTION

The present invention is a temporary support for a post that is both adjustable and sturdy. The frame attaches to the fence post. The frame includes a post holder and a plurality of legs that slide in the frame and hold the post while it is being placed, made plumb and set. Then this temporary frame is removed and can be reused.

In a preferred embodiment of the invention, the invention includes an angled frame that can be temporarily secured to a structural member such as a fence post and includes a plurality of channels through which legs may be slid to support the fence post.

Accordingly, it is an object of the present invention to provide an apparatus to temporarily hold a fence post in an upright secure manner while it is made plumb and set; an apparatus that it easily reusable and removable and; in a preferred embodiment, an apparatus in which comprises a frame made of a single piece of material.

Other objects and advantages of the present invention will be apparent from the following description, the accompanying drawing and the appended claims.

DETAILED DESCRIPTION

Figure 1:
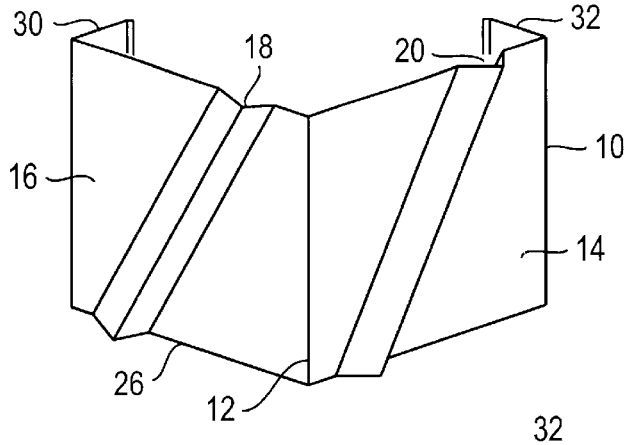
FIG. 1 is a front elevational view of a frame used in the temporary support for a fence post of the present.

The invention is a support for a fence post, which holds the post while it is being leveled and set into the ground. The support comprises a frame that attaches to the post temporarily. When set, then the frame is removed and can be reused. It should be noted that while this application and the included examples describe supporting a fence post, the invention could be used to support any similar structural member.

The frame of the present invention includes a portion to retain the frame on the fence post and a plurality of slots that allow a plurality of legs to slide in and out of the frame. These legs will extend from the frame to the ground and support the fence post with respect to the ground. The legs allow the fence post to be held in an upright vertical position, while it is leveled, made plumb and is set securely in the ground (i.e., while the concrete sets or the like). The legs and the frame are for temporary support and are reusable.

The frame is preferably made out of metal. More preferably, it is made of 16 to 26 gage sheet metal such as galvanized steel. However, other inexpensive materials may be used such as molded plastics.

As mentioned above, the frame includes a post-retaining portion to hold the frame on the fence post. The post-retaining portion is part of the same piece of material as the frame (i.e., formed from the same piece of sheet metal). In a preferred embodiment, the post-retaining portion is formed from the longitudinal edge of the frame that has been bent inwardly. This will be described in greater detail below. Other examples of post-retaining portions include a ridge bent inwardly from the frame or the inwardly protruding spikes of a punch cut. In this last embodiment, the inwardly facing spikes of the punch cut grip the wood of the fence post from the inner portion of the frame member. In still another embodiment, the post-retaining portion may be a tack that extends inwardly in the frame to hold the post.

The frame of the present invention also includes a plurality of leg-receiving channels. The channels are formed in the frame (i.e., from the same piece of sheet metal or whatever material is used) and are shaped to receive the legs by allowing them to slide through their openings. The legs, which support the fence post with respect to the ground, are preferably made of metal such as angle iron. Angle iron is advantageous because it is sturdy enough to support a fence post, and has corners that can easily be driven into the ground by pressing or by hammering the leg into the ground by means of a hammer. Alternatively, the legs can be made of other materials such as plastic, wood or other metals.

The legs, when secured to the frame are at an angle with respect to the bottom of the frame and the ground. This angle is present to provide support for the structural member. The fact that the legs are placed in the channels of the frame at an angle with respect to the frame, keeps the frame from sliding down along the length of the post. The legs are inserted in the channels such that at least a 30-degree angle and have a maximum of 70-degrees with respect to the bottom edge of the frame, and ultimately the ground. However, the preferred angle is approximately 45 degrees. In addition, the angled legs, once secured at the ground, will support the post via their connection to the frame. (The frame being attached to the post.) This will hold the post in a vertical position while workers back-fill the hole with concrete, dirt or other material.

An exemplary temporary support for a fence post is shown in FIG. 1. FIG. 1 shows a frame 10 that may be made of sheet metal or other similar material such as molded plastic that will be temporarily attached to a fence post. The fence post may be a typical 4" by 4" by any length fence post or similar structure that needs to be temporarily held in an upright vertical position. For illustrative purposes, the fence post is shown as a standard square fence post in FIG. 3. The frame 10 is angled along its length in its midpoint 12. This angle $\alpha$ is approximately 90 degrees to simulate the corner of the fence post. This creates two sides of the frame 14 and 16.

Figure 3:
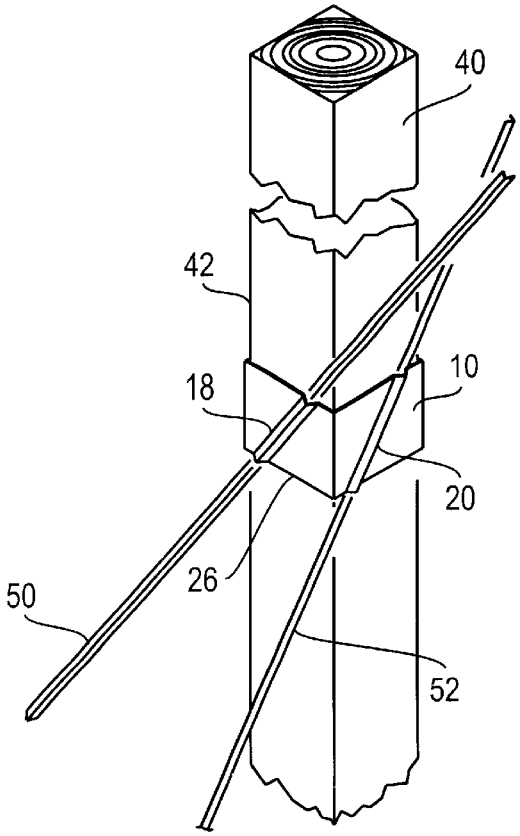
FIG. 3 a view of the frame of the present invention supporting the fence post by use of a plurality of legs.

Each side 14,16 of the frame 10 contains a leg-receiving portion that allows a leg to be slid in and out of the frame. The leg-receiving portion is preferably a triangular shaped channel 18,20 as shown in FIG. 1. This channel is formed from and integral with the piece of frame material. The channel 18 is formed of a size and shape to receive the legs as shown in FIG. 3. It extends the length of the frame 10 and is positioned at an approximately 45-degree angle with respect to the bottom edge of the frame 26. They are located such that the leg, when inserted makes an approximately 45-degree angle with respect to the bottom edge of the frame 26. The other side of the frame 14 has substantially identical leg-receiving portions. This second channel 20 is located such that it allows a second leg to be slid into the channel of the frame at an approximately 45-degree angle with respect to the bottom edge of the frame. The two leg-receiving portions are positioned on either side of the frame so that the legs are inserted at approximately, 90-degree angles with respect to one another and are located in different planes.

Alternatively, should the frame 10 be manufactured by a different process and material such as molded plastic, the leg-receiving portions of the frame may each be a molded slot or tube (not shown) along the face of the sides 14,16. Further, the leg-receiving portion could be cut and rolled from a piece of sheet metal. These slots or tubes would run at an approximately 45-degree angle with respect to the bottom edge of the frame 26.

Figure 2:
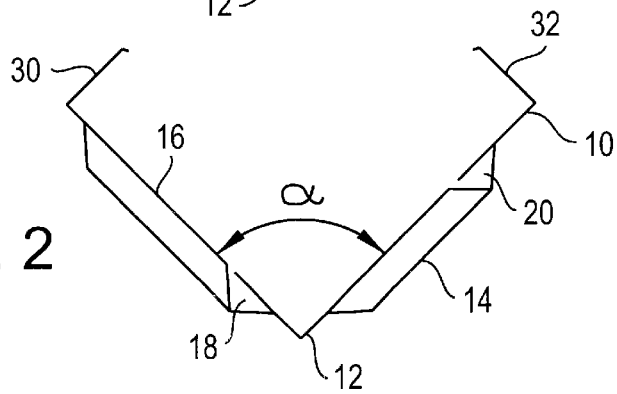
FIG. 2 is a top view showing the frame.

The frame 10 of the present invention also includes a post-retaining portion. The post-retaining portions in FIG. 1 are the two ears 30,32. They are formed from the same material as the frame 10 and preferably extend the entire length of the frame. The length of the ears 30,32 are such that they are long enough to hold the frame on the post but not so long as to impede the fitting of the frame around the corners of the post. The sizes and angles of the inward bend of the ears will be dependent upon the materials of manufacture (soft steel, molded plastic, etc.) to yield a frame 10 with ears 30,32 that effectively and easily "clip" or "snap" onto the post. Preferably, the ears 30,32 are bent inwardly from the sheet metal in the same bending step that forms the bend 12 and possibly channels 18 and 20. The ears 30,32 slip around the corners of the fence post as shown in FIG. 3. The ears 30,32 are preferably curved inwardly as shown in FIG. 2. This enables the frame to clamp tightly with the fence post. Alternatively, the ears can also be curved outwardly to facilitate the mounting of the frame on the fence post.

An advantage of this preferred embodiment of a temporary post support of the present invention is that the frame is of singular construction. The leg-receiving members and the post-retaining portions are all formed from the same single piece of material as the frame. Preferably, they can all be made by a single forming step of bending a single piece of sheet metal.

The use of the temporary post support will now be described in accordance with the present invention. The frame 10 is attached to the fence post 40 to be erected as shown in FIG. 3. Again, a square cross section fence post will be used as an example. However, it must be noted that a different shaped fence post or any other structural member may be used. A hole is dug in the ground or other horizontal surface by use of any known fence posthole digger as is known in the art. Then fence post 40 is inserted in the hole. As the hole provides no intrinsic support, something must be used to hold the post in a vertical position while it is made plumb and set.

The frame 10 of the present invention is placed against the fence post 40 so that one of the corners 42 of the fence post abuts the post-retaining ear 30. The frame 10 is wrapped around two sides of the fence post 40 and then the other post-retaining ear 32 bends over the diagonally opposing corner of the fence post. This "snaps" the frame on the fence post so that it does not slide vertically along the fence post. As the material of the frame is bendable but sturdy, the frame can be removed and reused.

The post is placed in an approximate upright vertical position in its hole. The fence post is then made plumb in a first plane (the x or y plane) using a level. Then a leg 50 is slid through one of the channels 18 or 20 and adjusted so that it holds the fence post level in the corresponding plane. The leg is then inserted into the ground by pushing manually, hammering or other means depending on the soil conditions. It should be noted that this type of leg arrangement is advantageous since the legs need not be inserted into the ground the same distance. Thereby, if one leg must be inserted in soft dirt while the other encounters clay or other harder surface, the temporary fence post support of the present invention will still provide the correct support to hold the fence post in an upright vertical position, while the concrete is set.

The next step is to plumb the fence post 40 in the remaining plane (y or x plane) using a level. A second leg 52 is then inserted in the corresponding channels on the side 14 of the frame, and the leg is pressed into the ground. The post is then permanently set into the ground by back-filling the hole with dirt or concrete. Once the post is secure in its upright plumb position, for example, when the concrete hardens, the legs 50,52 are removed and the frame 10 is removed from around the fence post 40. The temporary post support may then be reused for another fence post or other structural member.

Having described the invention in detail and by reference to preferred embodiments thereof, it will be apparent that modifications and variations are possible without departing from the scope of the invention defined in the appended claims.

What is claimed is:

1. A support for holding a post in an upright vertical position comprising:

(a) a frame constructed from a piece of material having an angle and shaped to temporarily attach to a post;

(b) a post-holding portion of said frame to temporarily secure said frame to the post;

wherein said post-holding portion of said frame is formed from said material and is integral with said frame and is capable of gripping the inserted post to temporarily secure said frame to the post;

(c) leg-receiving members formed from said material and integral with said frame and further, said leg-receiving members being positioned at an angle with respect to a bottom edge of said frame; and (d) a plurality of legs capable of being driven into the ground or other horizontal surface, wherein each leg-receiving member is shaped to receive one of said legs, and such that when said frame is attached to the post and said legs are driven into the ground or other horizontal surface, each of said plurality of legs independently slide in the leg-receiving members of said frame to temporarily support the post; such that the movement of one of said legs relative to said frame allows the post to be adjusted to be made plumb in the x or y plane.

2. The support of claim 1 wherein said plurality of legs are constructed of angle iron.

3. The support of claim 1 wherein said leg-receiving members are channels in said frame which have been formed by bending said material.

4. The support of claim 3 further including openings in said channels such that said channels are positioned so that their openings form an approximately 30–70 degree angle with respect to a bottom edge of said frame.

5. The support of claim 4 wherein said channels form an approximately 45-degree angle with respect to the bottom edge of said frame.

6. The support of claim 1 wherein said plurality of legs are removable and capable of sliding in said leg-receiving members such that said legs are positioned in the frame at an approximately 45 degree angle with respect to a horizontal axis.

7. The support of claim 1 wherein said support includes two legs, such that when said legs are inserted in said leg-receiving members in said frame, said legs form an angle of approximately 90 degrees with respect to each other.

8. The support of claim 7 wherein said leg-receiving members are positioned such that when said legs are inserted, they will be in different planes.

9. The support of claim 1 wherein said frame is capable of being removed from the post without significant deformation so that said frame is reusable.

10. The support of claim 1 wherein said post-holding portion is an inwardly extending ears that folds vertically from the side of said frame material.

11. The support of claim 10 wherein said inwardly extending ear is curved.

12. The support of claim 1 wherein said piece of material is sheet metal or plastic.

13. A support for holding a post in an upright vertical position comprising:

(a) a frame constructed of a single piece of material, said material having an angle and being shaped to temporarily attach to the post;

(b) a post-holding portion of said frame formed from said single piece of material and extending inwardly from said frame and being capable of temporarily gripping an inserted post;

(c) two leg-receiving channels in said frame formed from said single piece of material and capable of holding legs at an angle with respect to said frame; and (d) two legs shaped to fit in said leg-receiving channels, wherein said legs slide in said leg-receiving channels on a different plane with respect to one another and are capable of being driven into the ground so as to support the post with respect to the ground such that when said frame is attached to the post and said legs are driven into the ground, said legs independently slide in the leg-receiving members of the frame such that movement of one of said legs relative to the frame allows-the post to be adjusted to be made plumb in an x or y plane.

14. The support of claim 13 wherein said leg-receiving channels contain openings and said channels are positioned so that said openings form an approximately 30–70 degree angle with respect to a bottom edge of said frame.

15. The support of claim 14 wherein said channels form an approximately 45-degree angle with respect to the bottom edge of said frame and said legs are positioned in the frame at an approximately 45 degree angle with respect to horizontal.

16. The support of claim 15 wherein said legs form an angle of approximately 90 degrees with respect to each other.

17. The support of claim 13 wherein said material of said frame is sheet metal and said legs are constructed of angle iron.

18. The support of claim 13 wherein said frame is capable of being removed from the post without significant deformation so that said frame is reusable.

* * * * *